US007739930B2

(12) United States Patent
Schunke

(10) Patent No.: US 7,739,930 B2
(45) Date of Patent: Jun. 22, 2010

(54) UNIVERSAL KEY

(76) Inventor: Hermann Schunke, TalsperrenstraBe 19, Hilchenbach (DE) 57271

( * ) Notice: Subject to any disclaimer, the term of this patent is extended or adjusted under 35 U.S.C. 154(b) by 270 days.

(21) Appl. No.: 11/534,386

(22) Filed: Sep. 22, 2006

(65) Prior Publication Data

US 2007/0068348 A1 Mar. 29, 2007

(30) Foreign Application Priority Data

Sep. 22, 2005 (DE) ..... 10 2005 045 282

(51) Int. Cl.
*B25B 23/16* (2006.01)

(52) U.S. Cl. ..... 81/177.4; 81/177.1; 81/177.5; 81/177.6

(58) Field of Classification Search ..... 81/177.1, 81/177.4, 177.5, 177.6
See application file for complete search history.

(56) References Cited

U.S. PATENT DOCUMENTS

| | | | | | |
|---|---|---|---|---|---|
| 234,540 | A * | 11/1880 | Collins | 7/138 |
| 1,034,383 | A | 7/1912 | Bronson | |
| 4,848,197 | A | 7/1989 | Kikel | |
| 5,450,775 | A * | 9/1995 | Kozak | 81/440 |
| 6,032,332 | A * | 3/2000 | Lin | 16/111.1 |
| 6,397,709 | B1 * | 6/2002 | Wall | 81/440 |
| 7,021,181 | B1 * | 4/2006 | Chi | 81/490 |

FOREIGN PATENT DOCUMENTS

| | | |
|---|---|---|
| DE | 20212225 | 5/2002 |
| EP | 0079440 | 5/1983 |
| GB | 2318316 | 4/1998 |
| GB | 2382046 | 5/2003 |

OTHER PUBLICATIONS

EPO Search Report dated Feb. 11, 2009 received in corresponding EP application. Additional references previously cited in prior Information Disclosure Statements.

* cited by examiner

*Primary Examiner*—Joseph J Hail, III
*Assistant Examiner*—Shantese McDonald
(74) *Attorney, Agent, or Firm*—Grossman Tucker Perreault & Pfleger, PLLC

(57) ABSTRACT

The invention relates to a universal key (1), particularly a control cabinet key, with multiple key arms (2*a*, 2*b*, 2*c*, 2*d*), on which tool heads (12*a*, 12*b*, 13*a*, 13*b*) and/or retainers (5) for attaching tool heads (12*a*, 12*b*, 13*a*, 13*b*) or bits (6) are arranged, where at least one key arm (2*a*, 2*b*) forms a pen-shaped, hollow handle (3), and the hollow handle (3) displays at least one opening (10, 11), through which at least one other key arm (2*c*, 2*d*) can be folded out and in. (FIG. 1)

16 Claims, 3 Drawing Sheets

Figure 1:
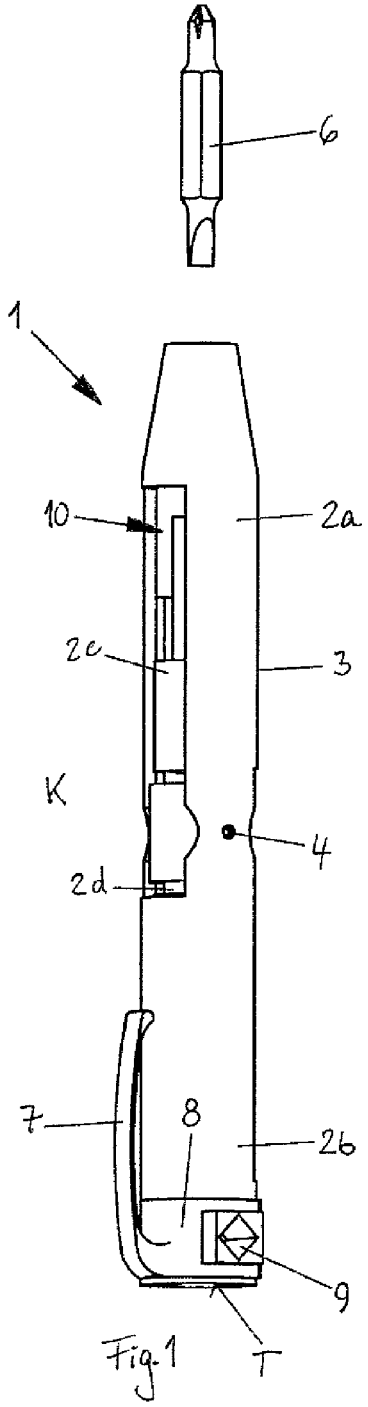

Fig.5
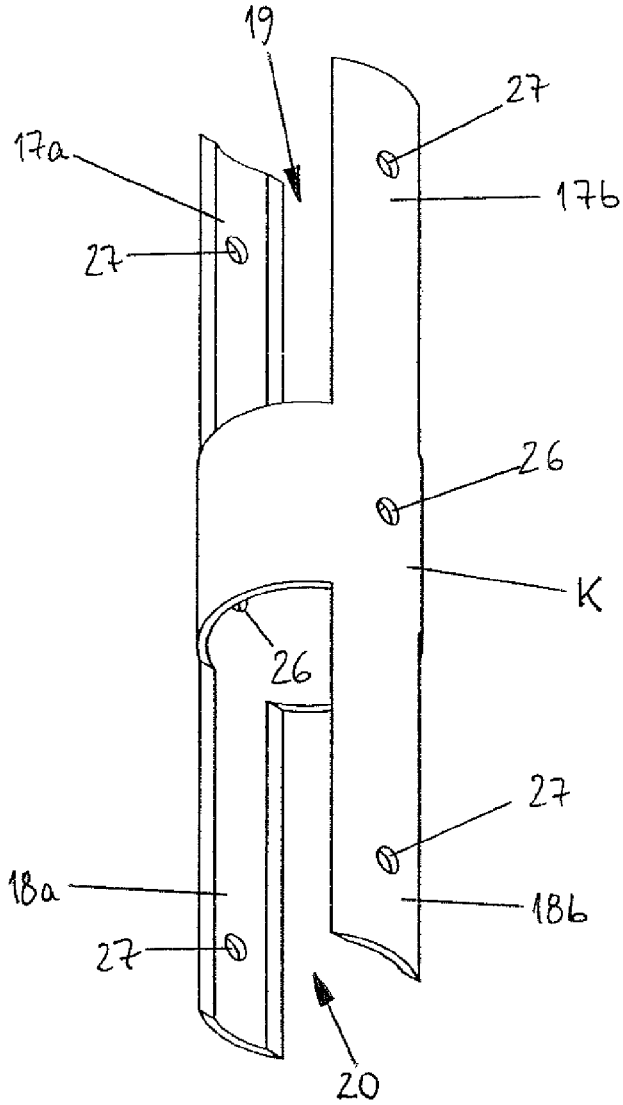
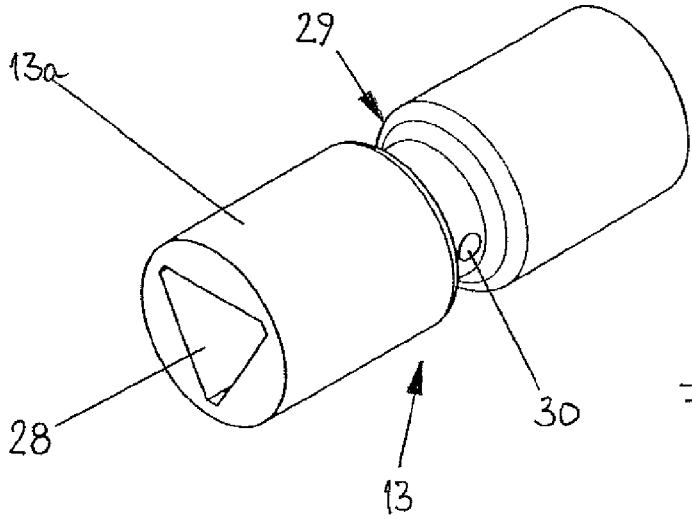
Fig. 6

UNIVERSAL KEY

The invention relates to a universal key, particularly a control cabinet key, with multiple key arms, on which tool heads and/or retainers for attaching tool heads or bits are arranged.

A universal key of this kind is known from German Utility Model 296 17 973 U1, for example. This universal key displays four key arms, arranged in the form of a cross. The tool heads of this universal key serve as locking tools for control cabinets. Control cabinets display locking elements that can, for example, be operated by means of a square, triangular or two-way key.

Persons involved in the installation or maintenance of control cabinets need a control cabinet key every day, meaning that they carry one with them at all times. A trouser or jacket pocket, such as is usually present on working clothes, suffices as the place for keeping a universal key of this kind.

Although a universal key fits in a jacket pocket, there is nonetheless a desire to further develop the known universal key and give it a more compact design for everyday use.

According to the invention, the object is solved in that at least one key arm forms a pen-shaped, hollow handle, and in that the hollow handle displays at least one opening, through which at least one other key arm can be folded out and in.

As a result of the movable connection of the key arms, the universal key can be collapsed into a pen-like structure having the appearance of a writing implement. The universal key according to the invention can advantageously be accommodated in a breast pocket, like a ballpoint pen. The universal key is favorably provided with a clip in the manner of a ballpoint pen. The clip fixes the universal key in place by firmly clamping it to the cloth. Handling of the universal key, i.e. its insertion into and removal from the pocket of a garment, is particularly simplified by the fact that the pen-like hollow handle displays no protruding key arms when in collapsed state.

The hollow handle can be turned like a screwdriver when in folded-in state. In this context, it is again of advantage that no laterally protruding key arms interfere with the turning movement. The hollow handle can be provided with a fixed screwdriving tool, or display a retainer for a bit or some other tool head.

The handling of the universal key is particularly good if both the hollow handle and the other key arm display a cylindrical cross-section, where the cylindrical outer surface of the key arm lies against the cylindrical inner surface of the hollow handle when in folded-in state. This results in the key arm being positively locked in the hollow handle.

To fold a key arm out of the hollow handle, this positive locking has to be overcome. The hollow handle is flexible to this end, and can be spread open elastically while folding out the key arm. The flexibility of the hollow handle can be determined by the choice of material and by the material thickness, such that a key arm can not only be folded out easily, but also displays sufficiently secure locking when folded in, and cannot fold out solely due to its own weight, for example.

The hollow handle can display a locking aid for securing the key arm in its folded-out position. The locking aid fixes the key arm in the optimum position for use.

The locking aid straightforwardly displays at least one transverse groove, formed in the wall of the cylindrical hollow handle. The transverse groove interacts with one end of the key arm. The axis of the key arm is aligned in the direction of the transverse groove.

The key arm is favorably enclosed between two opposite wall areas of the hollow handle, each opposite wall area displaying a transverse groove.

The transverse groove is advantageously of channel-shaped design and adapted to the outer surface of the key arm. This design results in exact fitting of the key arm in the transverse groove. To move the key arm from the folded-in position to the folded-out position, the hollow handle has to be spread open. Between the folded-in position and the folded-out position, a transitional edge has to be overcome that is formed between the transverse groove and the inner wall of the cylindrical hollow handle. This transitional edge is subject to wear as a result of the alternating inward and outward folding movements of the key arm. The wear can be reduced if, for example, the transitional edge is rounded off.

The possible uses of the universal key can be expanded if at least one key arm displays a turret element provided with several tool heads and/or retainers for alternative use.

The turret element is a rotating element, preferably displaying a lockable working position in which one of the tool heads or retainers can be fixed as required.

Straightforwardly, the key arm is of tubular design, one tube end of the key arm displaying two opposite holding tabs for the turret element, and a hinge pin for the turret element is mounted in the holding tabs.

The hollow, tubular design of the key arm creates space for accommodating the turret element. Provided alongside the holding tabs are recesses that create space for rotary movement of the turret element.

The universal key is particularly easy to handle if, in the working position of the turret element, a tool head and/or a retainer is enclosed by the holding tabs and locked in alignment with them, where the holding tabs can be spread elastically for rotation of the turret element. This design is very simple. The functional principle of locking the turret element in the key arm by means of elastic spreading of holding tabs of the key arm corresponds to the locking of the key arm, which can be locked in the hollow handle, since the locking of the key arm is likewise accomplished by elastic spreading, namely of the hollow handle when the key arm is moved from the folded-in position to the folded-out position, or vice versa.

A further advantage is achieved if the hollow handle displays an end with an end cap, and the end cap is provided with a carrier for an advertising logo.

The hollow handle is inexpensive and light if it is made of plastic.

A special design of the universal key provides for the hollow handle to integrate two key arms that are aligned with each other. In this embodiment, two further aligned key arms additionally form a one-piece cross-arm that can be folded out of the hollow handle and folded into the hollow handle. In this special embodiment, the universal key has the form of a key spider when in folded-out state. In this form, the universal key corresponds roughly to a customary control cabinet key with four key arms arranged in the shape of a cross.

The hollow handle of the universal key advantageously displays two openings, which are arranged in accordance with the direction of rotation of the cross-arm such that each end of the cross-arm can be folded out in one direction of rotation, and folded in in the opposite direction of rotation. In this embodiment, the cross-arm can only be folded out in one direction and folded in in one direction. The cross-arm cannot perform full rotation through 360°.

The cross-arm is preferably made of metal tubing.

Mounted in the hollow handle is a hinge pin, provided for the key arm(s) or for a cross-arm. The mounting point for the hinge pin must be designed in such a way that the hollow handle can be spread without the possibility of the hinge pin falling out of its mounting point. Furthermore, the hollow handle must display sufficient strength to transmit a torque when the universal key is used as a screw-driving tool. For this reason, the choice of the material for the hollow handle, and the wall thickness, are geared to the customary torques that have to be transmitted by the universal key.

Figure 2:
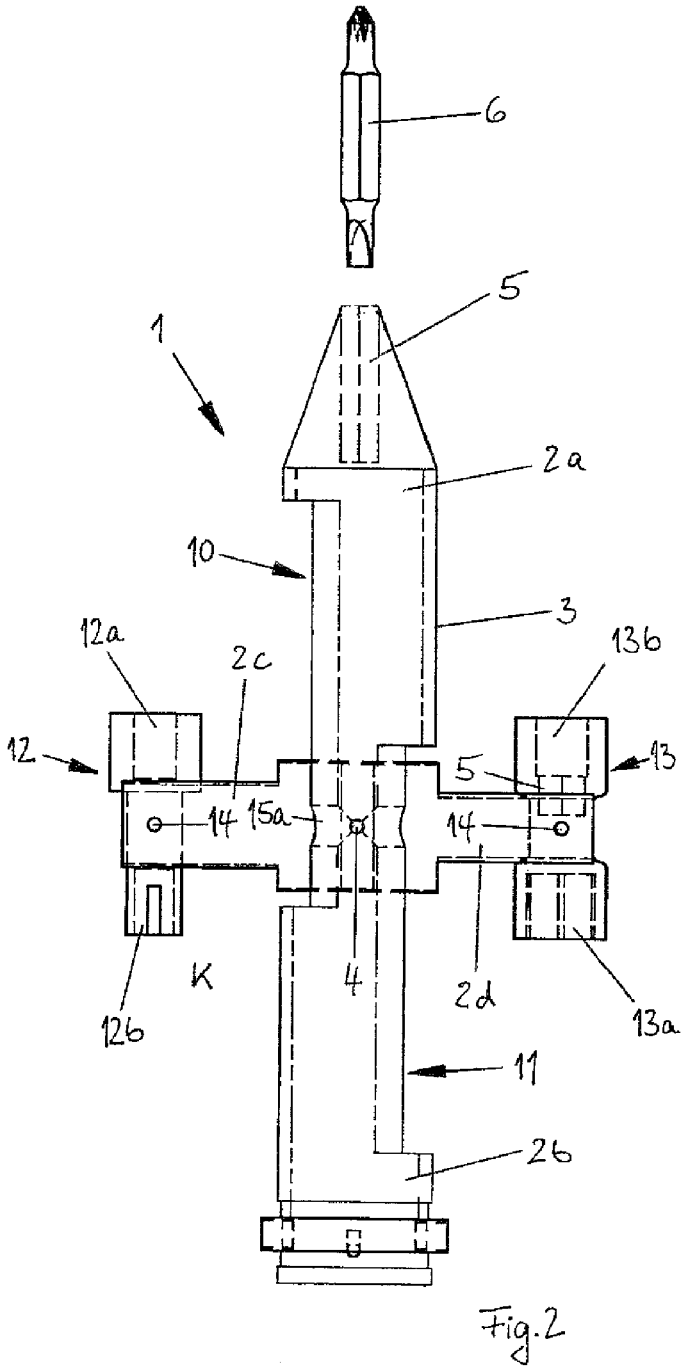

An example of the invention is illustrated in a drawing below, and described in detail on the basis of several Figures. The Figures show the following:

FIG. 1: A perspective view of a universal key, with the key arms folded in,

FIG. 2: A side view of the universal key according to FIG. 1, with the key arms folded out, FIG. 3: A front view of a hollow handle, FIG. 4: A side view of the hollow handle according to FIG. 3, FIG. 5: An enlarged, perspective illustration of a cross-arm, with holding tabs for a turret element, and FIG. 6: An enlarged, perspective illustration of a turret element.

FIG. 1 of the drawing shows a universal key 1, which is designed as a control cabinet key. It displays tool heads on multiple key arms 2*a*, 2*b*, 2*c* and 2*d*, with which locking elements of control cabinets can be opened and closed. Locking elements for control cabinets can display different forms. Familiar examples include triangular, square, hexagonal, and two-way keys, or a key with the so-called Daimler-Benz form, which is roughly a negative of the key form of the two-way key.

According to FIG. 1, universal key 1 displays a pen-shaped, hollow handle 3, which unites two key arms 2*a* and 2*b*. Moreover, two key arms 2*c* and 2*d* are accommodated in hollow handle 3. A hinge pin 4 is mounted roughly in the middle of oblong, pen-shaped hollow handle 3. Key arms 2*c* and 2*d*, accommodated inside hollow handle 3, can be folded out of hollow handle 3 about this hinge pin 4.

A retainer 5 for a bit 6 is provided on the front end of hollow handle 3. Mounted on the rear end of hollow handle 3 is a clip 7, by means of which the universal key can be fastened to the pocket of a garment, for example, in the manner of a ballpoint pen.

Clip 7 is attached to an end cap 8, which is slid onto the rear end of hollow handle 3. End cap 8 is furthermore provided with a square 9 and forms a carrier T for an advertising logo. This square 9 is used for opening and closing radiator venting valves. It is arranged transverse to the longitudinal extension of hollow handle 3.

The folded-out position of key arms 2*c* and 2*d* is illustrated in FIG. 2. According to the drawing, the two key arms 2*c* and 2*d* are aligned with each other and of one-piece design. One-piece key arms 2*c* and 2*d* will be referred to as cross-arm K below. This is because, in folded-out position, they cross hollow handle 3 in the middle, and the universal key thus forms a key spider that corresponds to a known control cabinet key with key arms arranged in the form of a cross, both in terms of its dimensions and as regards its use.

It can be seen in FIG. 2 that hollow handle 3 displays an opening 10 or 11 for each of the key arms 2*c* and 2*d* of cross-arm K. In keeping with the direction of rotation of cross-arm K, openings 10 and 11 are located on opposite ends of hollow handle 3. Starting from the position shown in FIG. 2, cross-arm K has to be folded back in the opposite direction of rotation to fold it in. It is not possible to rotate cross-arm K farther in the folding-out direction.

Located on the free ends of cross-arm K are so-called turret elements 12 and 13, each of which displays two tool heads, 12*a*, 12*b* and 13*a*, 13*b*. A retainer 5 for a bit is integrated in tool head 13*b*.

The position of turret elements 12 and 13 shown in FIG. 2 is intended to illustrate that each of turret elements 12 and 13 can be rotated about a hinge pin 14. The illustrated position of turret elements 12 and 13 is not the position in which they are used. To position them for use, turret elements 12 and 13 must each be turned 90° farther or back in one or the other direction about hinge pin 14. Turret elements 12 and 13 are then aligned with cross-arm K and can be used in this position.

The present practical example of the universal key permits cross-arm K to be fixed in both the folded-in position and the folded-out position. Cross-arm K is described in more detail below on the basis of FIG. 5.

For fixing in the folded-in and folded-out position of cross-arm K, the invention exploits the round cross-section of tubular cross-arm K and the round cross-section of hollow handle 3.

The outside diameter of cross-arm K almost corresponds to the inside diameter of hollow handle 3. In folded-in state, cross-arm K is enclosed in hollow handle 3 in form-fitting fashion. Cross-arm K cannot be folded out of hollow handle 3 simply because the latter displays openings 10 and 11, but only because hollow handle 3 can be spread open to a certain degree. Without said spreading of hollow handle 3, cross-arm K would be retained in the hollow handle in form-fitting fashion. The possibility of spreading open hollow handle 3 permits folding movement and locking of cross-arm K.

So that the spreading of hollow handle 3 can again be elastically reversed in the position illustrated in FIG. 2, the inner side of hollow handle 3 is provided with transverse grooves 15*a* and 15*b*, which are likewise adapted to the round cross-section of cross-arm K. When folded out, cross-arm K is aligned with transverse grooves 15*a* and 15*b*. This causes reversal of the elastic spreading of hollow handle 3.

As a result of this design, transverse grooves 15*a* and 15*b* act as a locking aid in order to maintain the folded-out position of cross-arm K.

In this way, cross-arm K is enclosed by transverse grooves 15*a* and 15*b* on both sides in the area of the piercing point of hinge pin 4. Cross-arm K lies in short transverse groove 15*a* as in a channel, and is held in the aligned position. Transverse groove 15*b* acts in the same way. The situation is similar as regards the folded-in position of cross-arm K in hollow handle 3. Hollow handle 3 is likewise of channel-shaped design. The hollow handle holds cross-arm K in the aligned position. The design can be such that residual elastic spreading of hollow handle 3 generates an initial tension that forces cross-arm K into transverse grooves 15*a* and 15*b*.

The channel-shaped contours of transverse groove 15*a* and the inner wall of hollow handle 3 transition into each other in the area of hinge pin 4. This gives rise to transitional edges 16*a*, 16*b*, 16*c* and 16*d*. These transitional edges 16*a*, 16*b*, 16*c* and 16*d* have to be overcome in order to switch from the folded-in position to the folded-out position. The elastic spreading of hollow handle 3 occurs during this process. Since cross-arm K can only be folded out in one direction of rotation, and folded in in the opposite direction of rotation, only two of the four transitional edges are stressed, namely 16*a* and 16*c*. This is because cross-arm K only scrapes over these two transitional edges during the alternating inward and outward folding movements. The cross-arm moves away from the other two transitional edges, 16*b* and 16*d*, meaning that no wear occurs there.

The aligned position of turret elements 12 and 13 in the ends of cross-arm K is secured according to the same principle as the aligned, folded-in position of cross-arm K in hollow handle 3. Each turret element 12 or 13 displays tool heads 12*a* and 12*b* or 13*a* and 13*b*, the outside diameter of which corresponds to the inside diameter of tubular cross-arm K. When a turret element 12 or 13 is aligned with cross-arm K, the tool head of turret element 12 or 13 lies against the cylindrical inner surface of cross-arm K. Cross-arm K displays holding tabs 17*a*, 17*b* and 18*a*, 18*b* at its two ends, as well as recesses 19 and 20 between them. Recesses 19 and 20 create space for rotation of turret elements 12 and 13. To rotate turret element 12 or 13 out of the aligned position, holding tabs 17*a*, 17*b*, or 18*a*, 18*b*, have to be spread elastically. As soon as a tool head again moves into a position aligned with cross-arm K during rotation, spread holding tabs 17*a*, 17*b*, or 18*a*, 18*b*, again spring back and fix the position of turret head 12 or 13. In this context, residual elastic spreading can generate an initial tension that forces the turret elements between the holding tabs.

Figure 3:
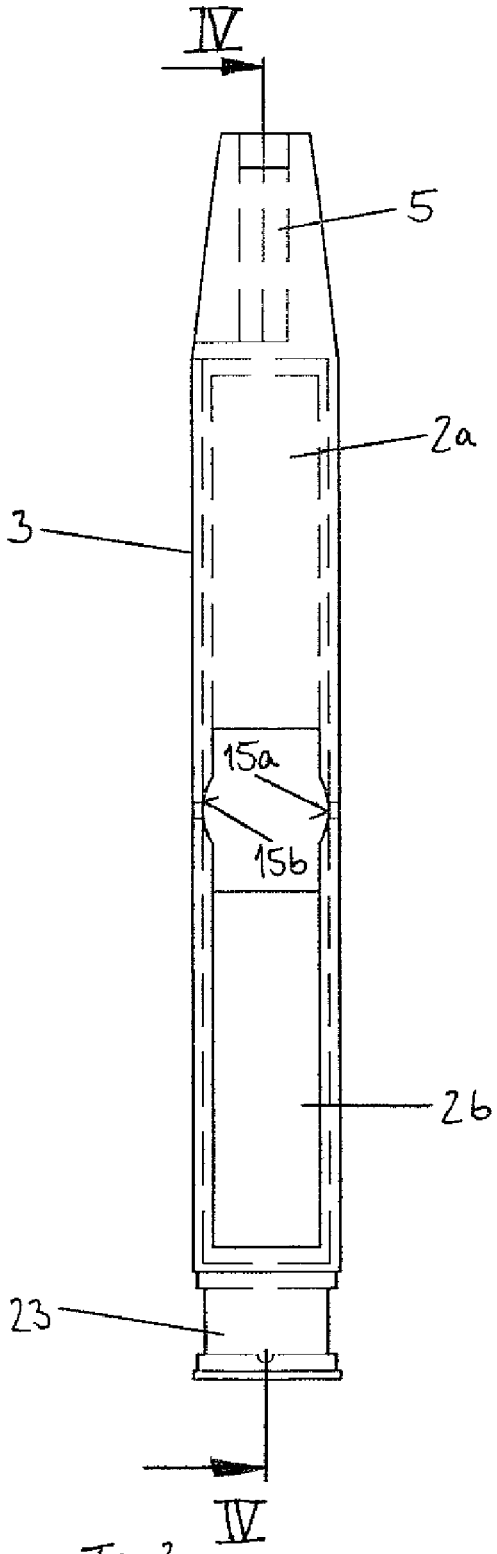
Figure 4:
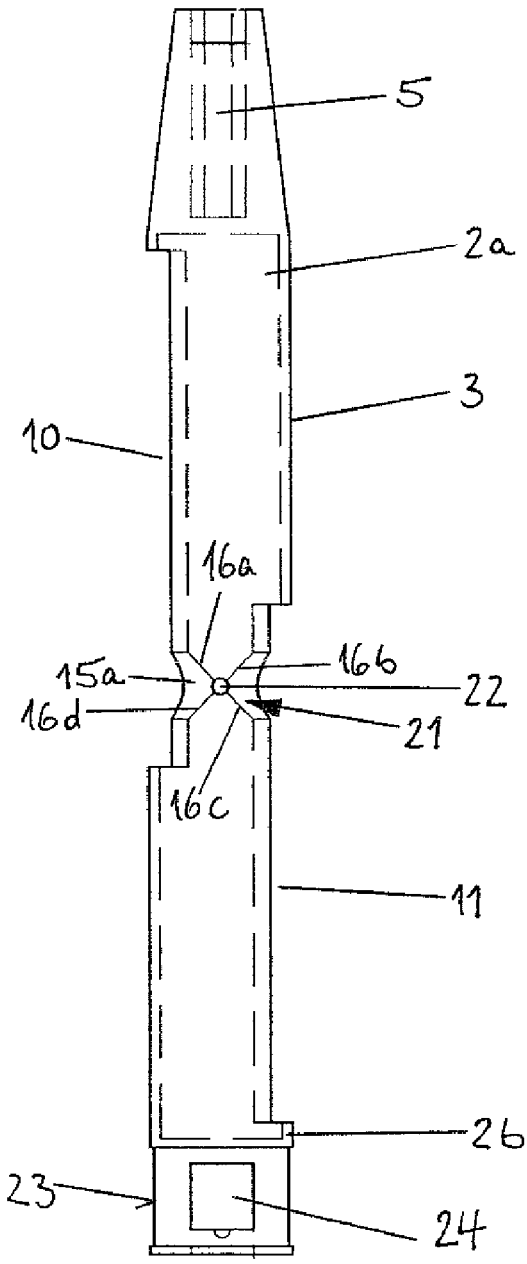

The design of hollow handle 3 is illustrated in FIGS. 3 and 4. Transverse grooves 15*a* and 15*b*, which are provided for fixing the folded-out position of cross-arm K in hollow handle 3, can be seen in FIG. 3. Transverse grooves 15*a* and 15*b* have a channel-shaped cross-section.

FIG. 4 shows a cross-sectional side view along the line indicated in FIG. 3. A hole 22 for accommodating hinge pin 4 for cross-arm K is shown in this view. Furthermore, transitional edges 16*a*, 16*b*, 16*c* and 16*d* can be seen in FIG. 4, resulting where the contour of transverse groove 15*a* transitions into the cylindrical inner wall of hollow handle 3. This results in the four transitional edges 16*a*, 16*b*, 16*c* and 16*d*, which form a diagonal cross 21 in FIG. 4. Located at the centre of diagonal cross 21 is a hole 22 for hinge pin 4.

Likewise clearly visible in FIG. 4 are openings 10 and 11 of hollow handle 3, which each extend into the area of transverse groove 15*a*. On the one side of hollow handle 3, opening 10 extends from transverse groove 15*a* towards the front end of hollow handle 3, while opposite opening 11 extends from transverse groove 15*a* towards the rear end of hollow handle 3. The rear end of hollow handle 3 is provided with a mounting area 23 for end cap 8. Mounting area 23 has a slightly smaller diameter than the remainder of hollow handle 3. Provided in mounting area 23 is a square hole 24, which penetrates mounting area 23 transverse to the longitudinal extension of hollow handle 3. Mounting area 23 and square hole 24 serve to accommodate end cap 8 which, according to FIG. 1, displays clip 7 and square 9, which is located in square hole 24 of mounting area 23. Square 9 is provided for operating radiator venting valves.

A loose cross-arm K is illustrated in enlarged form in FIG. 5. Cross-arm K is a tubular component, the two ends of which display holding tabs 17*a*, 17*b* and 18*a*, 18*b*, as well as recesses 19 and 20 provided between the holding tabs. In the middle of cross-arm K is a fully cylindrical area, in the wall of which two holes 26 are provided for accommodating one hinge pin 14 each. Holding tabs 17*a*, 17*b* and 18*a*, 18*b* likewise display holes 27 for hinge pins 14. As can best be seen in FIG. 2, turret elements 12 and 13 are mounted in rotating fashion by means of hinge pins 14 in holding tabs 17*a*, 17*b* and 18*a*, 18*b*.

A turret element 13 is shown in enlarged form in FIG. 6. Turret element 13 displays two tool heads 13*a* and 13*b*. One tool head 13*a* is provided with a triangular opening 28, which serves to operate a control cabinet locking element displaying an external triangle. A grooved area 29, displaying a transverse hole 30, can be seen in the middle of turret element 13. Transverse hole 30 serves to accommodate a hinge pin 14, the ends of which are mounted in holding tabs 18*a* and 18*b* of cross-arm K.

LIST OF REFERENCE NUMBERS

1 Universal key
2*a* Key arm
2*b* Key arm
2*c* Key arm
2*d* Key arm
3 Hollow handle
4 Hinge pin
5 Retainer
6 Bit
7 Clip
8 End cap
9 Square
10 Opening
11 Opening
12 Turret element
12*a* Tool head
12*b* Tool head
13 Turret element
13*a* Tool head
13*b* Tool head
14 Hinge pin
15*a* Transverse groove
15*b* Transverse groove
16*a* Transitional edge
16*b* Transitional edge
16*c* Transitional edge
16*d* Transitional edge
17*a* Holding tab
17*b* Holding tab
18*a* Holding tab
18*b* Holding tab
19 Recess
20 Recess
21 Diagonal cross
22 Hole
23 Mounting area
24 Square hole
26 Hole
27 Hole
28 Triangular hole
29 Grooved area
30 Transverse hole
K Cross-arm
T Carrier

The invention claimed is:

1. Universal key comprising multiple key arms, on which tool heads and/or retainers for attaching tool heads or bits are arranged, characterized in that a first and a second of said multiple key arms are aligned to form a pen-shaped, hollow handle, and in that the hollow handle displays at least one opening through which at least a third key arm can be folded out and in, wherein said at least a third key arm can be folded around a hinge pin arranged in the middle of said pen-shaped hollow handle to form a cross, characterized in that said at least a third key arm displays a rotatable turret element provided with several tool heads and/or retainers for alternative use.

2. Universal key according to claim 1, characterized in that both the hollow handle and said at least a third key arm display a cylindrical cross-section, where the cylindrical outer surface of said at least a third key arm lies against the cylindrical inner surface of the hollow handle when in folded-in state.

3. Universal key according to claim 1, characterized in that the hollow handle displays a locking aid for securing said at least a third key arm in its folded-out position.

4. Universal key according to claim 3, characterized in that the locking aid displays at least one transverse groove, formed in the wall of the cylindrical hollow handle.

5. Universal key according to claim 4, characterized in that the transverse groove is of channel-shaped design and adapted to the outer surface of said at least a third key arm.

6. Universal key according to claim 1, characterized in that said at least a third key arm is of tubular design, one tube end of said at least a third key arm displaying two opposite holding tabs for the turret element, and in that a hinge pin for the turret element is mounted in the holding tabs.

7. Universal key according to claim 6, characterized in that, in the working position of the turret element, a tool head and/or a retainer is enclosed by the holding tabs and locked in alignment with them, where the holding tabs can be spread elastically for rotation of the turret element.

8. Universal key according to claim 1, characterized in that the first of said multiple key arms which forms said hollow handle displays an end with an end cap, and in that the end cap is provided with a carrier for an advertising logo.

9. Universal key according to claim 1, characterized in that the hollow handle is made of plastic.

10. Universal key according to claim 1, characterized that a fourth key arm forms a one-piece cross-arm with said third key arm wherein said cross-arm can be folded out of the hollow handle and folded into the hollow handle.

11. Universal key according to claim 10, characterized in that the hollow handle displays two openings, which are arranged in accordance with the direction of rotation of the cross-arm such that each end of said one-piece cross-arm can be folded out in one direction of rotation, and folded in in the opposite direction of rotation.

12. Universal key according to claim 1, characterized in that the cross-arm is made of metal tubing.

13. Universal key according to claim 1 wherein said hollow handle includes a transitional edge, wherein said transitional edge must be overcome to fold out or fold in said third key arm.

14. Universal key comprising multiple key arms, on which tool heads and/or retainers for attaching tool heads or bits are arranged, characterized in that at least one of said multiple key arms forms a pen-shaped, hollow handle, and in that the hollow handle displays at least one opening through which at least one other key arm may be folded out and in, characterized in that said at least one other key arm displays a rotatable turret element provided with several tool heads and/or retainers for alternative use.

15. Universal key comprising multiple key arms, on which tool heads and/or retainers for attaching tool heads or bits are arranged, characterized in that a first and a second of said multiple key arms are aligned to form a pen-shaped, hollow handle, and in that the hollow handle displays at least one opening through which at least a third key arm can be folded out and in, wherein said at least a third key arm can be folded around a hinge pin arranged in the middle of said pen-shaped hollow handle to form a cross, characterized in that the first of said multiple key arms which forms said hollow handle displays an end with an end cap, and in that the end cap is provided with a carrier for an advertising logo.

16. Universal key comprising multiple key arms, on which tool heads and/or retainers for attaching tool heads or bits are arranged, characterized in that a first and a second of said multiple key arms are aligned to form a pen-shaped, hollow handle, and in that the hollow handle displays at least one opening through which at least a third key arm can be folded out and in, wherein said at least a third key arm can be folded around a hinge pin arranged in the middle of said pen-shaped hollow handle to form a cross, characterized that a fourth key arm forms a one-piece cross-arm with said third key arm wherein said cross-arm can be folded out of the hollow handle and folded into the hollow handle, further characterized in that the hollow handle displays two openings, which are arranged in accordance with the direction of rotation of the cross-arm such that each end of said one-piece cross-arm can be folded out in one direction of rotation, and folded in in the opposite direction of rotation.

* * * * *